US007395558B2

(12) United States Patent
Mothaffar

(10) Patent No.: US 7,395,558 B2
(45) Date of Patent: Jul. 8, 2008

(54) NECK PROTECTOR FOR USE WITH A CRASH HELMET

(76) Inventor: Hussain Y. A. M. Mothaffar, P.O. Box 2135, Al-Salmiya, KW (KW) 22022

( * ) Notice: Subject to any disclaimer, the term of this patent is extended or adjusted under 35 U.S.C. 154(b) by 0 days.

(21) Appl. No.: 11/456,010

(22) Filed: Jul. 6, 2006

(65) Prior Publication Data

US 2007/0083987 A1 Apr. 19, 2007

Related U.S. Application Data

(63) Continuation-in-part of application No. 11/235,266, filed on Sep. 27, 2005.

(51) Int. Cl.
*A42B 7/00* (2006.01)

(52) U.S. Cl. ..... 2/421

(58) Field of Classification Search ..... 2/421, 2/468, 425, 415, 416, 411; 280/290, 801.1
See application file for complete search history.

(56) References Cited

U.S. PATENT DOCUMENTS 3,278,230 A * 10/1966 Boyce et al. ..... 297/465
4,638,510 A * 1/1987 Hubbard ..... 2/6.1
4,923,147 A * 5/1990 Adams et al. ..... 244/122 AG
5,123,408 A * 6/1992 Gaines ..... 2/425
5,272,770 A * 12/1993 Allen et al. ..... 2/421
5,371,905 A * 12/1994 Keim ..... 2/413
5,517,699 A * 5/1996 Abraham, II ..... 2/425
6,006,368 A * 12/1999 Phillips ..... 2/468
6,009,566 A * 1/2000 Hubbard ..... 2/468
6,052,835 A * 4/2000 O'Shea ..... 2/468
6,308,345 B1 * 10/2001 Williams, Jr. ..... 2/468
6,588,022 B1 * 7/2003 Anders et al. ..... 2/421
6,751,809 B1 * 6/2004 Cooper et al. ..... 2/421
6,810,535 B1 * 11/2004 Moloney ..... 2/411
6,931,669 B2 * 8/2005 Ashline ..... 2/422
6,968,576 B2 * 11/2005 McNeil et al. ..... 2/425

* cited by examiner

*Primary Examiner*—Danny Worrell
(74) *Attorney, Agent, or Firm*—Lowe Hauptman Ham & Berner, LLP

(57) ABSTRACT

A restraint system is disclosed which limits the range of motion of a driver's helmet, and consequently the flexure of an individual's neck. In particular, the proposed system is laterally symmetric and comprises an arrangement of straps including a first strap extending from the "chin" of the helmet downwardly over the shoulder to an attachment point near the shoulder blade. A second strap extend form the occipital region forward over the shoulder and is attached on the chest. A separate strap also extends from the chin to the mid-point of the second strap. A fourth strap extends from the occipital region to the mid-point of the first strap. In addition, a harness is disclosed comprising a strap which encircles the check and straps which encircle the thighs, and use of a VELCRO fastener to anchor the restraint system to the harness.

8 Claims, 11 Drawing Sheets

FIG. 18
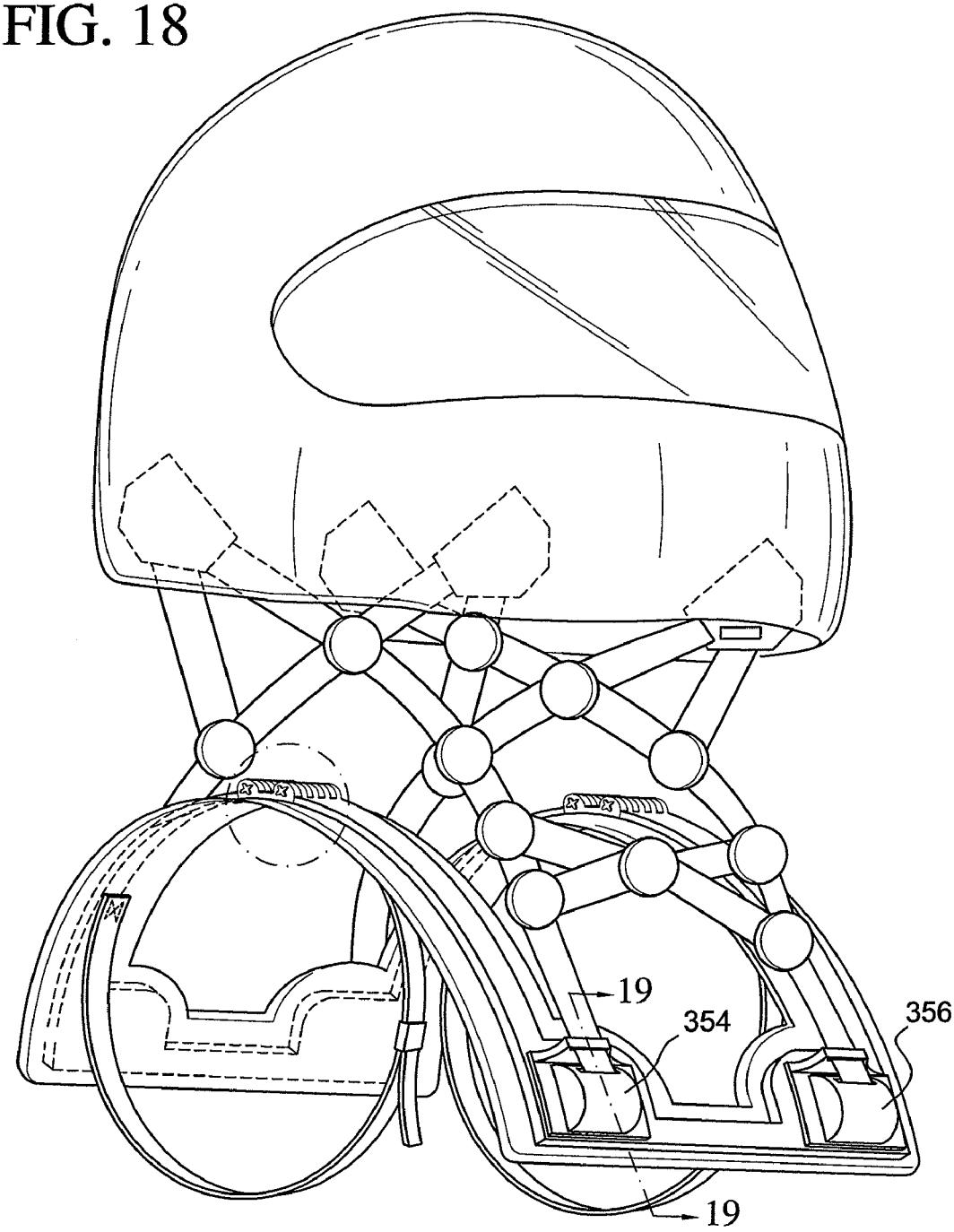
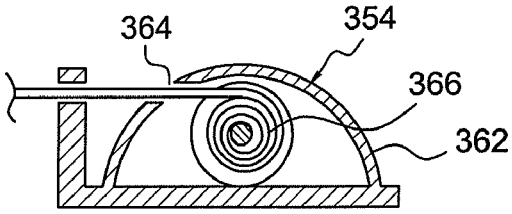
FIG. 19

368
370
372
374
376
378
380
382
384
386
388

NECK PROTECTOR FOR USE WITH A CRASH HELMET

CROSS REFERENCE TO RELATED APPLICATIONS

This is a continuation-in-part of application Ser. No. 11/235,266, filed Sep. 27, 2005, the contents of which is incorporated herein by reference.

TECHNICAL FIELD

The present invention is generally directed toward a head and neck protector, and more specifically, directed toward a head and neck restraint system for use with a helmet for protecting a driver's head and neck during a crash.

BACKGROUND OF THE INVENTION

Protecting the head and neck of drivers for high speed race cars or motorcycles is highly desirable. In order to protect the driver's head, the use of a crash helmet is common. However, the use of the helmet does not limit the range of motion of the driver's neck and does not restrain the neck. Therefore, this allows the neck of the driver to uncontrollably snap move in different directions during a crash.

It is therefore a primary object of the present invention to provide a restraint system usable with a crash helmet which limits the range of motion of a driver's head, and consequently the flexure of the driver's neck.

It is another object of the invention to provide a restraint system that is easily worn and uses with a conventional helmet.

It is a further object of the invention to provide a device which maintains the head and neck of the driver in alignment with the driver's spine during a frontal impact of a high performance vehicle.

SUMMARY OF THE INVENTION

These problems and others are addressed by the present invention which comprises a head and neck restraint system for protecting the neck of an individual during a crash of a motor vehicle, the head and neck restraint system comprising a head enclosing helmet of the type having a head shell surrounding the head, forehead, and chin of the individual with an opening at a bottom portion thereof and a face portion, a plurality of straps and means for releasably securing the plurality of straps to a portion of the helmet, means for securing the plurality of straps to the individual, and, wherein the plurality of straps form an X-pattern configuration on a right side and a left side of said user below the helmet.

BRIEF DESCRIPTION OF DRAWINGS

These and other objects of the present invention will be appreciated and understood by those skilled in the art from the detailed description of the preferred embodiments of the invention and the following drawings of which:

FIG. 18 is a perspective view of the neck restraint system in accordance with a sixth representative embodiment of the present invention;

FIG. 19 is a side sectional view of a strap retaining means of the sixth representative embodiment shown in FIG. 18;

DETAILED DESCRIPTION OF THE INVENTION

Figure 1:
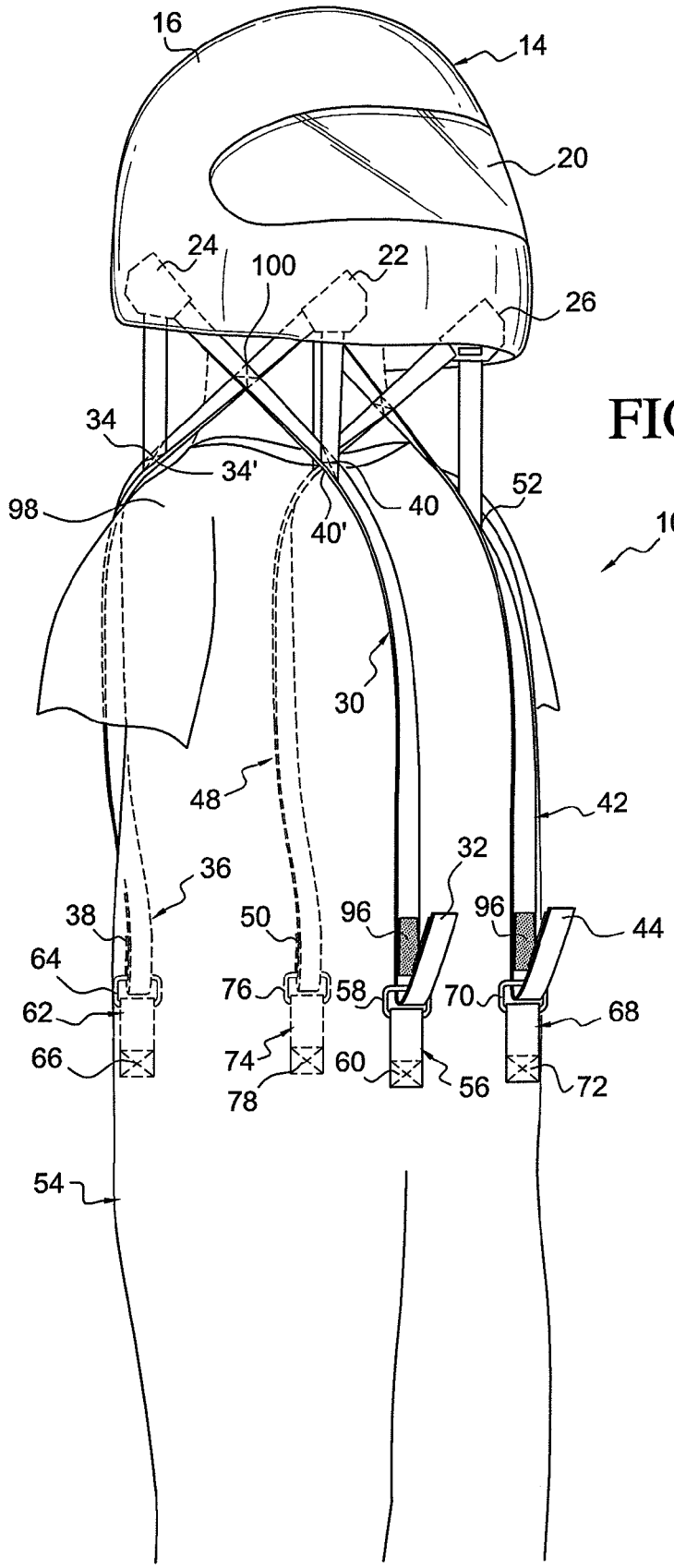
FIG. 1 is a perspective view of the preferred embodiment of the neck restraint system in an assembled configuration attached to a helmet on an individual.
Figure 3:
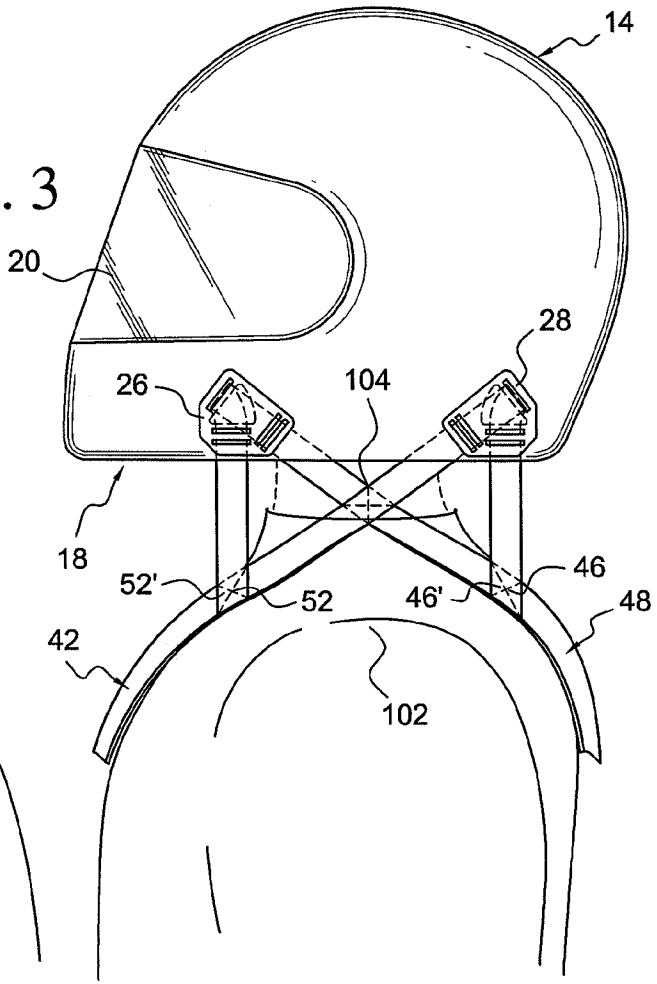
FIG. 3 is left side elevation view of the neck restraint system of FIG. 1.
Figure 2:
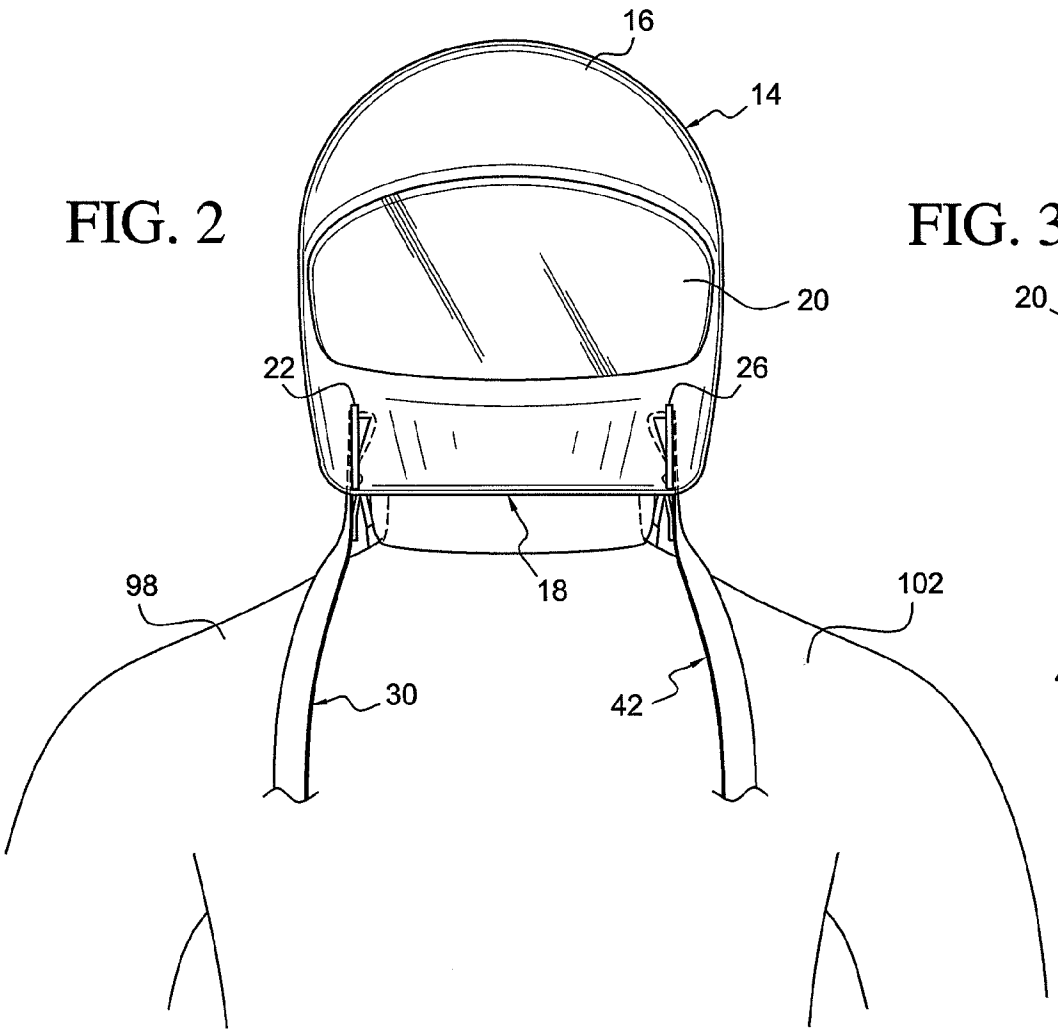
FIG. 2 is a front elevation view of the neck restraint system of FIG. 1.
Figure 4:
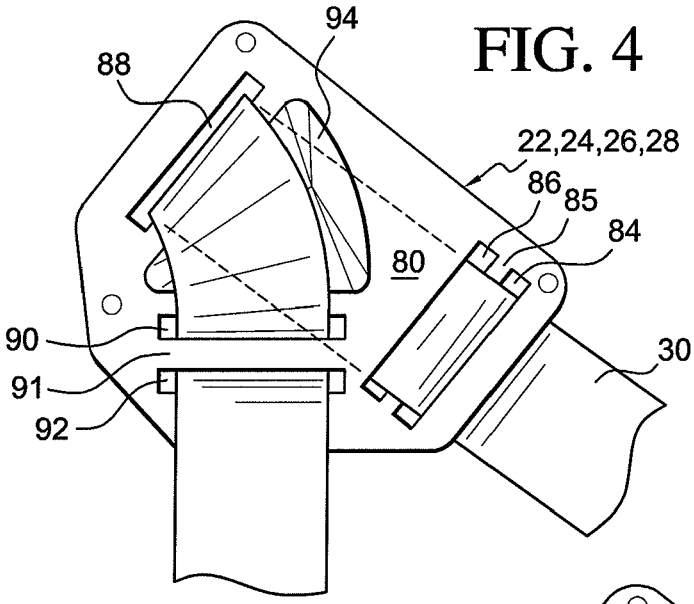
FIG. 4 is top plan view of a directive anchor used for securing the straps of the neck restraint system to the helmet.
Figure 5:
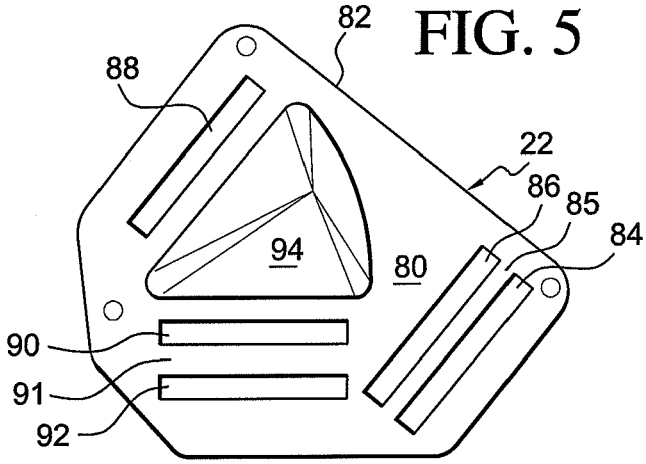
FIG. 5 is the top plan view of the strap directive anchor of FIG. 4 in a non-use configuration.
Figure 6:
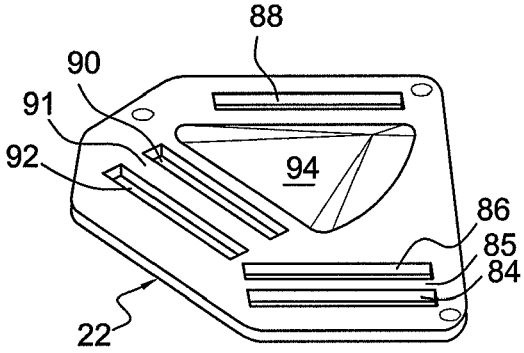
FIG. 6 is a side perspective of the strap directive anchor of FIG. 4 in a non-use configuration.
Figure 7:
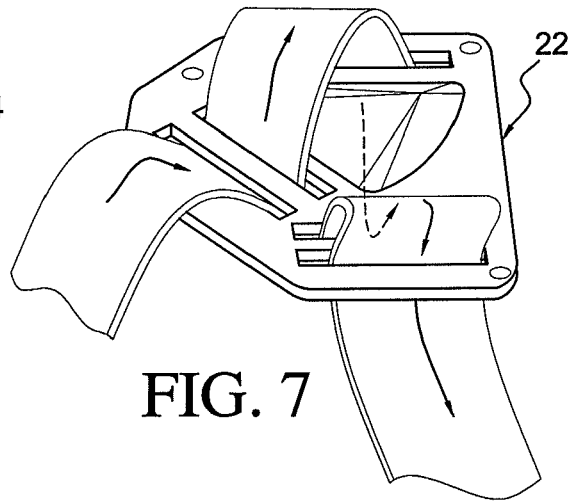
FIG. 7 is a perspective view of the strap directive anchor of FIG. 4 illustrating the way the straps are directed and attached thereto.

Referring now to the drawings, wherein the showings are for the purpose of illustrating the preferred embodiment of the invention only and not for the purpose of limiting the same, referring to FIGS. 1-3, a neck restraint system is generally shown at 10 being used by a user 12 and attached to a crash helmet 14. The helmet 14 includes a head shell 16 and a bottom opening 18 for providing access for the user's head, and a frontal opening 20 to provide visibility for the user when the user has the helmet on.

In the first representative embodiment of the present invention, the neck restraint system 10 comprises a plurality of laterally symmetrical straps that are attached to the helmet 14 at one end and are removably attached to the user's outfit at opposing second end.

The neck restraint system 10 comprises a plurality of directive anchors and, more specifically and preferably, four directive anchors wherein a first directive anchor 22 is attached to an inner and frontal right side of the helmet shell 16, a second directive anchor 24 is attached to the inner and rear right side of the helmet shell 16, a third directive anchor 26 is attached to the inner and frontal left side of the helmet shell 16, and a fourth directive anchor 28 is attached to the inner and rear left side of the helmet shell 16. The first and the second directive anchors 22, 24 are preferably symmetrically positioned with respect to the third and fourth directive anchors 26, 28. Also, the number of the directive anchors are not limited to four and, alternatively, they may be positioned and attached to the outside of the helmet shell 16. The first, second, third, and fourth directive anchors 22, 24, 26, 28 preferably have identical shapes and configurations, as best seen FIGS. 4-7, and provide an attaching means for securing the plurality of straps of the neck restraint system to the helmet.

The neck restraint system 10 further includes a first strap or belt 30, preferably made of nylon, polyester, cotton, or combinations thereof, having a first end 32 and a second end 34, a second strap 36 having a first end 38 and a second end 40, a third strap 42 having a first end 44 and a second end 46, and a fourth strap 48 having a first end 50 and a second end 52, configured and attached to one another in a manner that will be explained in a greater detail herein.

As best seen in FIG. 1, the first representative embodiment of the present invention requires the neck restraint system 10 to be attached to a user's outfit or race suit, generally illustrated at 54. A plurality of anchor straps are attached at the outer portion of the user's race suit 54 generally below the user's abdomen area. More specifically, a first anchor strap 56 having a first metal loop 58 attached to a first end thereof, and a second end 60 attached, preferably, but not limited to, by stitching to the front side outer portion of the race suit 54. A second anchor strap 62 having a second metal loop 64 attached to a first end thereof, and a second end 66 attached by, preferably, but not limited to, stitching to the rear side outer portion of the race suit 54. A third anchor strap 68 having a third metal loop 70 attached to a first end thereof, and a second end 72 attached by, preferably, but not limited to, stitching to the front side outer portion of the race suit 54. And a fourth anchor strap 74 having a fourth metal loop 76 attached to a first end thereof, and a second end 78 attached by, preferably, but not limited to, stitching to the rear side outer portion of the race suit 54. As will be explained herein, the first, second, third, and fourth anchor straps 56, 62, 68, and 74 are laterally and symmetrically positioned and attached to the race suit for providing support for the first, second, third, and fourth straps 30, 36, 42 and 48, respectively.

Referring to FIGS. 4 through 7, the first directive anchor 22 is illustrated. As stated hereinabove, the first, second, third and fourth directive anchors 22, 24, 26, and 28 are preferably identical in shape and configuration, and therefore, the structural features and the fastening means of each directive anchor is described and illustrated in view of the first directive anchor 22 only. The first directive anchor 22 includes a top surface 80, a bottom surface 82 and a plurality of elongate slots providing a plurality of openings from the top surface 80 to the bottom surface 82. More specifically, the first directive anchor 22 includes a first slot 84 and a second parallel slot 86 disposed at one side thereof and separated from the first slot 84 by a first divider 85, a third slot 88 substantially parallel to the first and the second slots 84, 86, a fourth slot 90 and a fifth slot 92 separated from the fourth slot 90 by a second divider 91 and parallel to the fourth slot 90 at a second side of the first directive anchor and substantially below the first, the second, and third slot 84, 86, 88. The first directive anchor 22 further includes a pyramid-configured protrusion 94 on the top surface 80 and positioned and bounded by the second slot 86, third slot 88, and the fourth slot 90, wherein, as will be explained in greater 7; detail, the straps of the neck restraint system are extended over the pyramid-configured protrusion 94.

Referring now to FIGS. 1 through 7, the assembled neck restraint system 10 will be explained. In order to attach the neck restraint system 10 to the helmet 14 and the race suit 54 of the user, the first strap 30 is attached to the second directive anchor 24 by extending the first strap second end 34, or in the alternative, the first strap first end 32, through the first slot 84 from underneath, then over the first divider 85, through the second slot 86 and underneath the second directive anchor 24, up through the third slot 88 and over the pyramid-configured protrusion 94 and through the fourth slot 90, underneath the second divider 91, and then up through the fifth slot 92. The first strap second end 34 is then attached by, preferably, but not limited to, stitching to an upper portion of the second strap 36 at 34'. Now, the first strap first end 32 is of a length and dimensioned and configured to extend and be inserted through the first metal loop 58 attached to the first anchor strap 56, and folder over and secured to itself by a fastening means, such as, but not limited to, a VELCRO brand fastening means 96.

The second strap 36 is slidably disposed within or attached to the first directive anchor 22 in a substantially similar manner as the first strap 30 being attached to the second directive anchor 24, wherein the second strap second end 40 is attached, preferably by stitching to the first strap 30 at 40' and just above the user's right shoulder 98, and the second strap first end 38 extends through the second anchor strap second metal loop 64 and is folded and secured to itself by a VELCRO brand fastening means 96.

The substantially mid-point of the portion of the first strap 30 between where the second strap first end 40 is attached or stitched to the first strap 30 at 40' and the second directive anchor 24 is also stitched and attached at a point 100 to substantially the mid-point of the portion of the second strap 36 between where the first strap second end 34 is attached to stitched to second strap 36 at 34' and the first directive anchor 22. Therefore, as best seen in FIG. 1, the right side of the neck restraint system 10 in the assembled configuration and right above the right shoulder 98 of the user includes an X-pattern configuration resulting from the portions of the first strap 30 and the second strap 36 being attached to the helmet.

As best seen in FIGS. 1 and 3, the third strap 42 is slidably disposed within or attached to the fourth directive anchor 28 in a substantially similar manner as the first strap 30 being attached to the second directive anchor 24, wherein the third strap second end 46 is attached, preferably by stitching to the fourth strap 48 at 46' just above the user's left shoulder 102, and the third strap first end 44 extends through the third metal loop 70 and is folded and secured to itself by a VELCRO brand fastening means 96. Similarly, the fourth strap 48 is slidably disposed within or attached to the third directive anchor 26 as the first strap 30 being attached to the second directive anchor 24, wherein the fourth strap second end second end 52 is attached, preferably by stitching to the third strap 42 at 52' just above the user's left shoulder 102, and the fourth strap first end 50 extends through the fourth anchor strap metal loop 76 and is folded and secured to itself by a VELCRO fastening means 96. Alternatively, other fastening means may be used instead of the VELCRO fastening means 96 such as, but not limited to, a belt and buckle securing means.

The substantially mid-point of the portion of the fourth strap 48 between where the third strap second end 46 is attached or stitched to the first strap 30 at 46' and the third directive anchor 26 is also stitched and attached at a point 104 to substantially the mid-point of the portion of the third strap 42 between where the fourth strap second end 52 is attached and stitched to third strap 42 at 52' and the fourth directive anchor 28.

Therefore, as best seen in FIG. 3, the left side of the neck restraint system 10 in the assembled configuration and above the left shoulder 102 of the user includes an X-pattern configuration resulting from the portions of the fourth strap 48 and third strap 42 being attached to the helmet.

Figure 8:
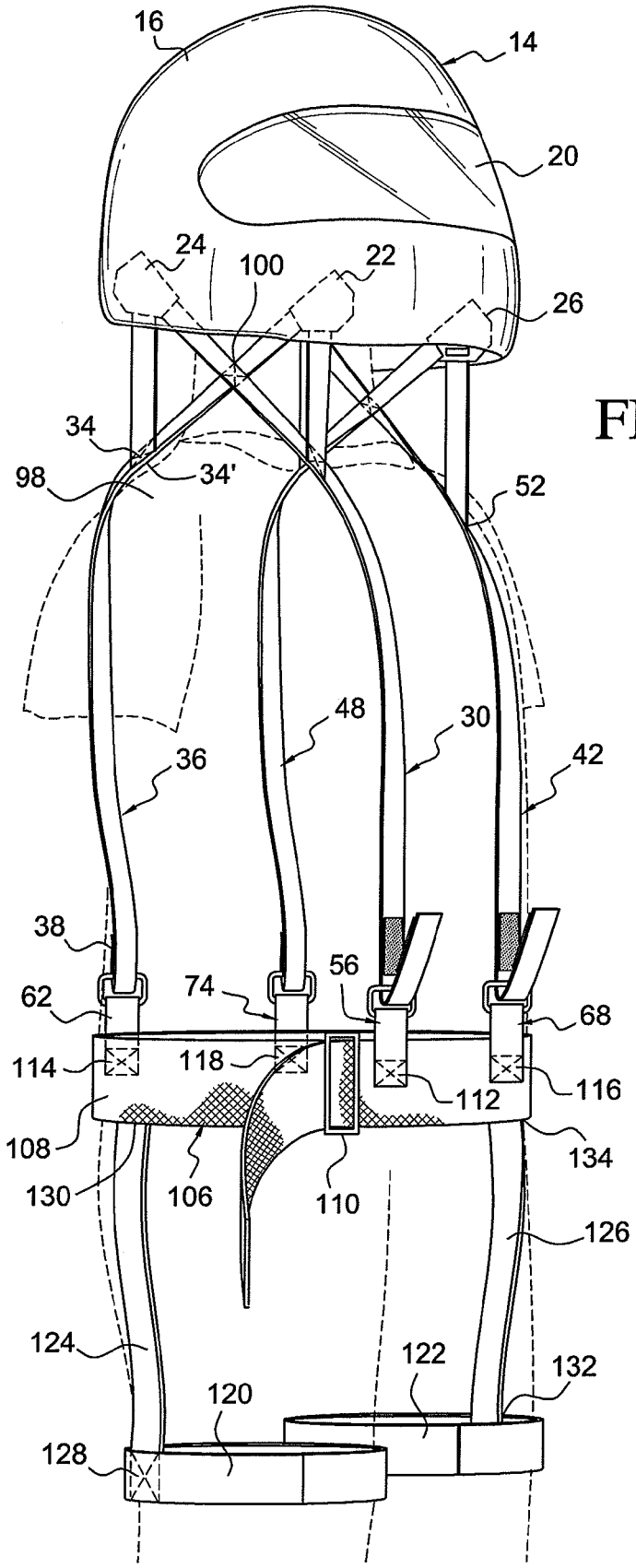
FIG. 8 is a perspective view of the neck restraint system including a body attachment harness.

Referring now to FIG. 8, a second representative embodiment of the neck restraint system is illustrated wherein the first, second, third, and fourth, 30, 36, 42, and 48 are attached to a harness assembly 106 instead of being directly attached to the user's race outfit. The harness assembly 106 comprises a main belt portion 108 having a buckle 110 which can be adjustably worn by the user around the user's waist. The first anchor strap 56 is now attached, preferably by stitching, to the main belt 108 at a second end 112, and similarly, the second anchor strap 62 is attached to the main belt 108 at a second end 114, the third anchor strap 68 is attached to the main belt 108 at a second end 116, and the fourth anchor strap 74 is attached to the main belt at a second end 118.

The harness assembly 108 further includes a leg attachment means comprising a right leg strap 120 dimensioned and configured to be wrapped around the user's right leg, preferably around the user's right thigh and above the right knee, and removably secured by an attaching means such as, but not limited to, a VELCRO brand fastener.

A right leg extension 124 includes a first end 128 securely attached to the right leg strap 120 preferably by stitching, and a second end 130 attached to a lower portion or the inside of the main belt 108. A left leg strap 122 dimensioned and configured to be wrapped around the user's left leg, preferably around the user's left thigh and above the left knee, and removably secured by an attaching means such as a VELCRO brand fastener. A left leg extension 126 includes a first end 132 securely attached to the left leg strap 122 preferably by stitching, and a second end 134 attached to a lower portion or the inside of the main belt 108.

Figure 9:
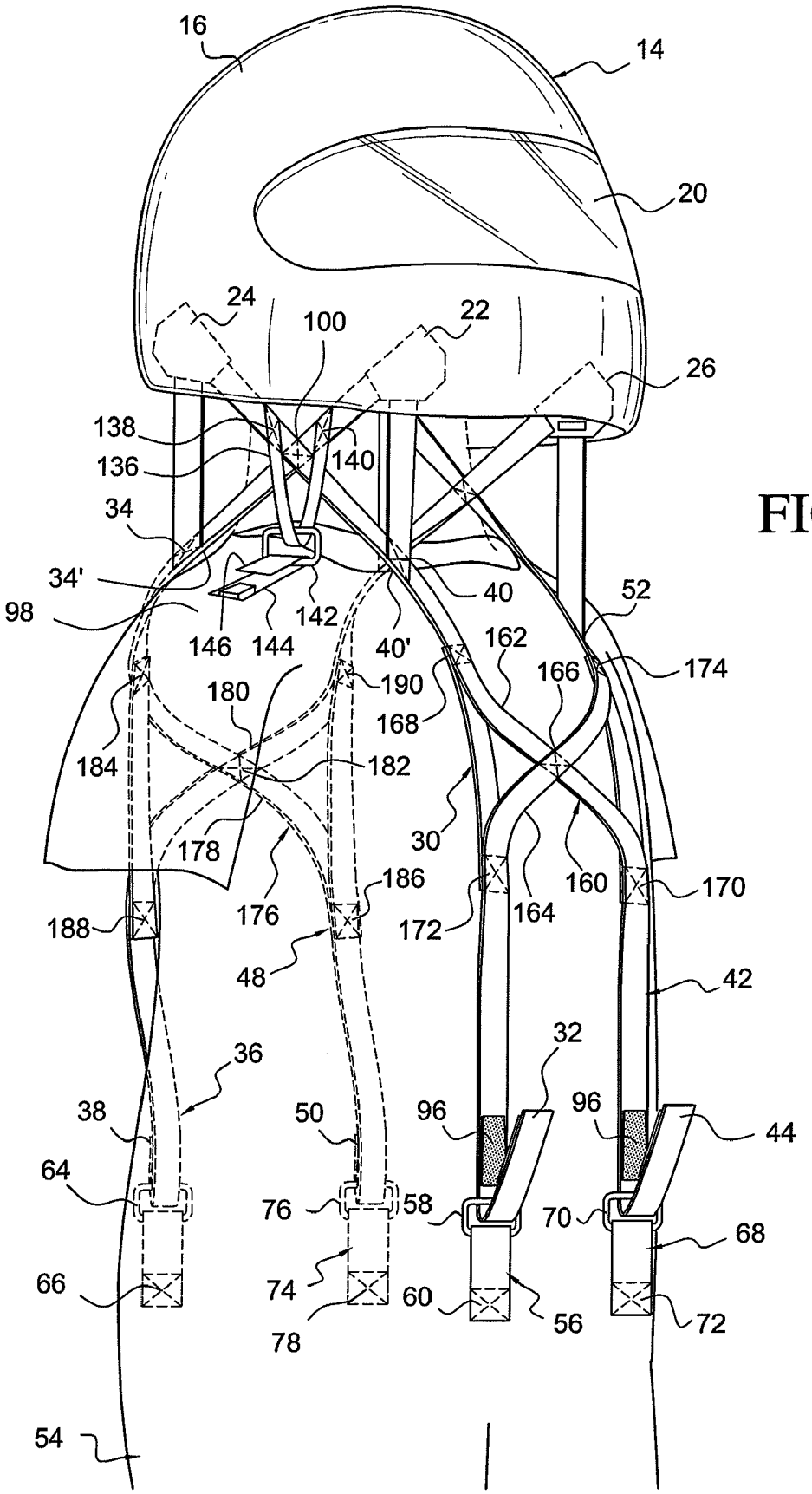
FIG. 9 is a perspective view of a third representative embodiment of the neck restraint system in an assembled configuration attached to a helmet on an individual.
Figure 11:
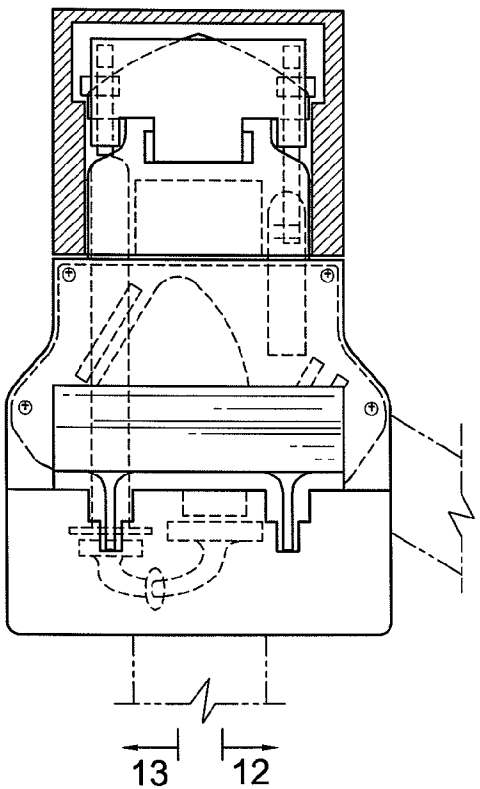
FIG. 11 is a side elevation view of a removable locking mechanism for the fourth representative embodiment shown in FIG. 10.
Figure 10:
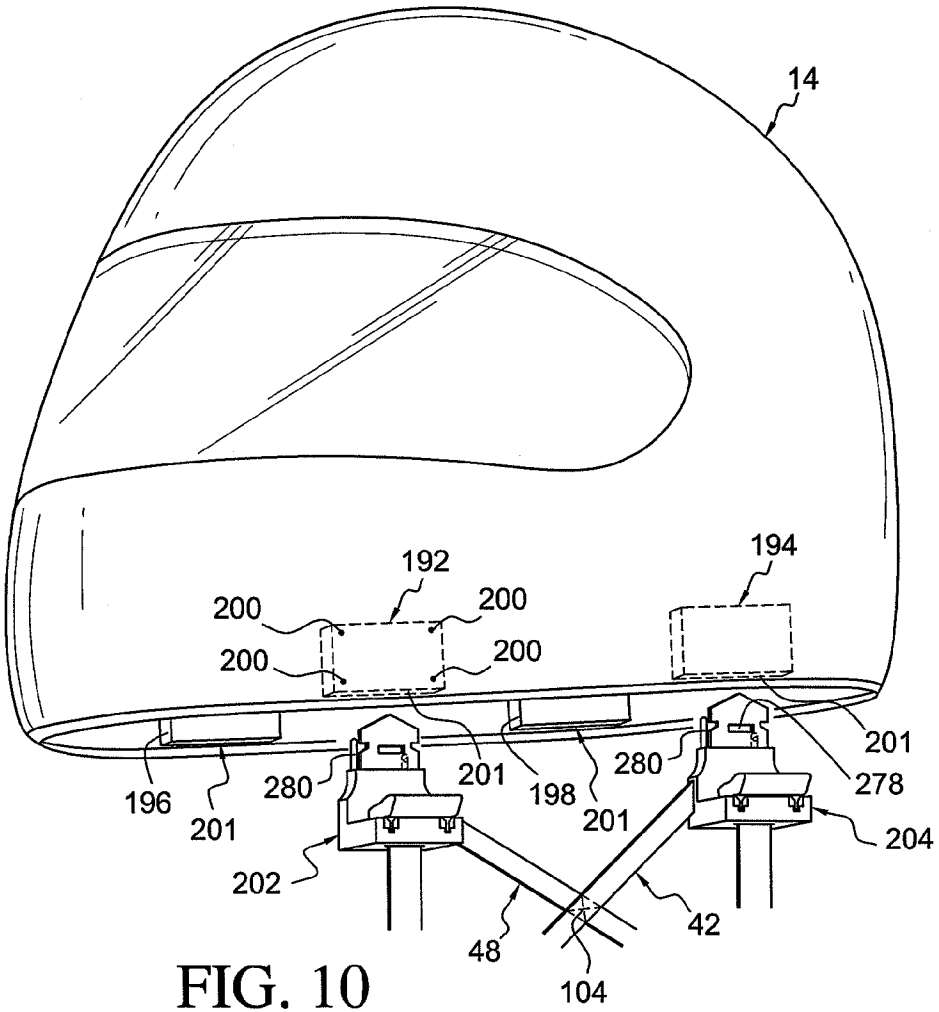
FIG. 10 is left side elevation view of the neck restraint system in accordance with a fourth representative embodiment of the present invention.

Referring now to FIG. 9, a third alternative embodiment of the neck restraint system 10 is illustrated. A fifth strap 136 having a first end 138 and a second end 140 provides further stability and securement of the system when in use by having the first end 138 attached, preferably by stitching, to the first strap 30 right above the point 100 and the second end 140 similarly attached to the second strap 36 right above the point 100. The fifth strap 136 also includes a metal loop 142 which is freely slidable between the first and the second ends 138, 140.

A fifth anchor strap 144 is attached, preferably by stitching, to the user's race outfit right above the right shoulder 98, wherein the fifth anchor straps's free end 146 can loop through the metal loop 142 and secure the fifth strap 136 by having the free end 146 attached to the opposing end of the fifth anchor strap 144 by means of VELCRO or other suitable removable means.

Similarly, for the left side of the neck restraint system, a sixth strap 148 having a first end 150 and a second end 152 provides further stability and securement of the system when in use by having the first end 150 attached, preferably by stitching, to the third strap 42 right above the point 104 and the second end similarly attached to the fourth strap 48 right above the point 104. The sixth strap 136 also includes a metal loop 154 which is freely slidable between the first and the second ends 150, 152.

A sixth anchor strap 156 is attached, preferably by stitching, to the user's race outfit right above the left shoulder 102, wherein the sixth anchor straps's free end 158 can loop through the metal loop 154 and secure the sixth strap 148 by having the free end 158 attached to the opposing end of the sixth anchor strap 156 by means of VELCRO or other suitable removable means.

Moreover, additional X-pattern straps maybe attached to the front and the back of the neck restraint system 10 to limit the rotational and circular movement of the user's helmet while in use. More specifically, a front X-pattern strap 160 includes a strap 162 and a strap 164 attached in the middle at 166, wherein, as best seen FIG. 9, the first and the second ends of the strap 162 are attached to the first strap 30 and the third strap 42 at 168 and 170, respectively, and the first and the second ends of the strap 164 are attached to the first strap 30 and the third strap 42 at 172 and 174, respectively.

Similarly, a rear X-pattern strap 176 includes a strap 178 and a strap 180 attached in the middle at 182, wherein, as best seen FIG. 9, the first and the second ends of the strap 178 are attached to the second strap 36 and the fourth strap 48 at 184 and 186, respectively, and the first and the second ends of the strap 180 are attached to the second strap 36 and the fourth strap 48 at 188 and 190, respectively.

Referring now to FIGS. 10 through 14, a fourth alternative embodiment of the neck restraint system 10 is illustrated. More specifically, this embodiment contemplates the use of a removable mechanism for attaching and detaching the neck restraint system 10 from the user's helmet 14.

A plurality of female anchor receivers are attached to the inner front and rear sides of the helmet. More specifically, a first female anchor receiver 192 and a second female anchor receiver 194 is attached to the inner front left side and inner rear left side of the helmet 14 by means of, but not limited to, a plurality of screws 200. Similarly, a third female anchor receiver 196 and a fourth female anchor receiver 198 is attached to inner front right side and inner rear right side of the helmet 14 by means of, but not limited to, the plurality of screws 200. These female anchor receivers replace the first, second, third, and fourth directive anchors to provide for a detachable and removable assembly of the neck restraint system for the helmet.

Each of the first, second, third, and fourth female anchor receivers 192, 194, 196, and 198 includes a bottom opening 201 to provide, as will be explained herein, access for the detachable male anchors.

A plurality of male anchors, and more specifically, a first, second, third, and fourth male anchors 202, 204, 206, and 208 are provided to replace the first, second, third, and fourth directive anchors to attach the straps, and the first, second, third, and fourth male anchors, 202, 204, 206, and 208 are detachably attached to the first, second, third, and fourth female anchor receivers 192, 194, 196, and 198, respectively, in a manner that will be discussed in a greater detail below. It is noted that the first, the second, third, and fourth male anchors 202, 204, 206, and 208 are preferably identical to one another and, therefore, their details will be only discussed in relation to the first male anchor 202.

Figure 13:
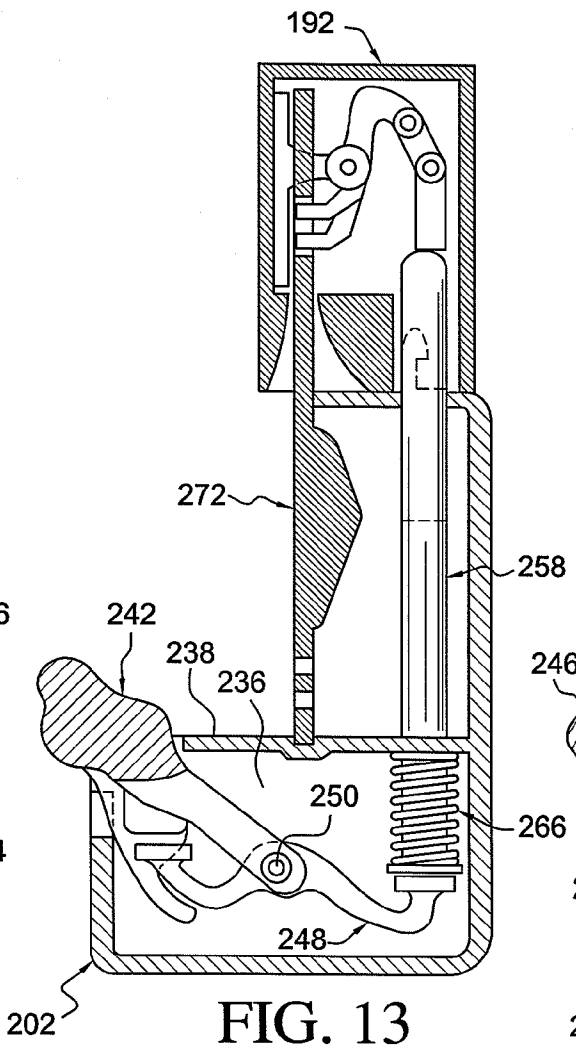
FIG. 13 is a cross-sectional view of FIG. 11 taken along the line 13-13.
Figure 12:
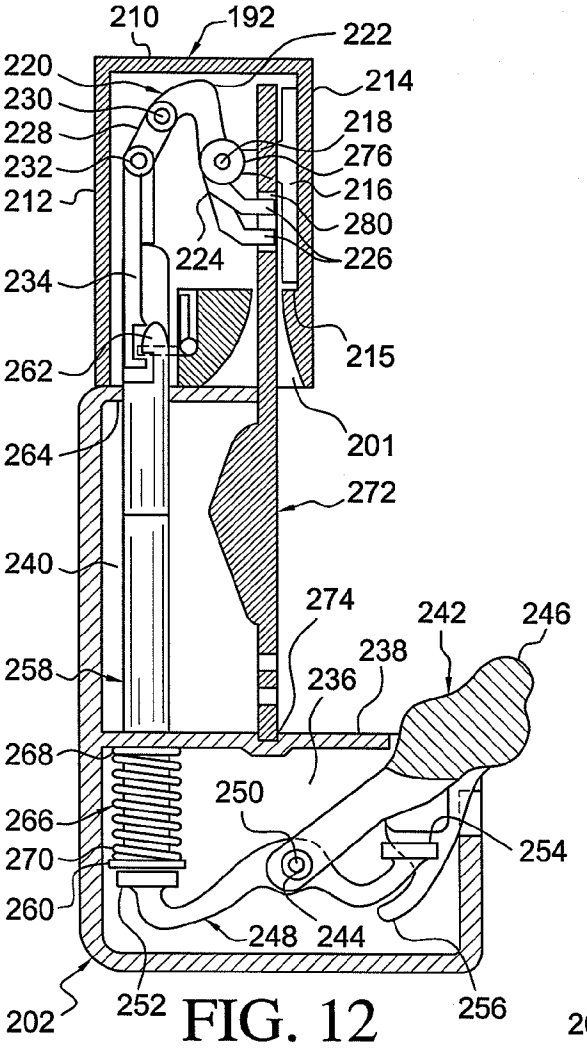
FIG. 12 is a cross-sectional view of FIG. 11 taken along the line 12-12.

Referring now to FIGS. 12 and 13, the first female anchor receiver 192 includes a top wall 210, a first sidewall 212, and a second sidewall 214 bounding the bottom opening 201. A support plate 216, preferably made from metal or other suitable material, is secured to the inner surface of the second sidewall 214 and further includes an extension arm having a circular pivot end 218. The second sidewall 214 further includes a protrusion 215 on the inner side thereof for providing further support to hold the support plate 216.

A hook-shaped linkage arm 220 includes a first portion 222 and a second portion 224 integral with the first portion 224, wherein the second portion 224 further includes a fork-shaped end having a pair of tines 226. The linkage arm 220 is pivotally attached to the support plate 216 at the circular pivot end 218 in a pivoting and balanced way, wherein the linkage arm 220, as best seen in FIG. 12, can pivot about the pivot end 218 in either a clockwise direction or a counter clockwise direction.

A second linkage arm 228 includes a first end and is pivotally attached to a second end of the first portion 222 of the hook-shaped linkage arm 220 at 230, and a second end 232 pivotally attached to a third linkage arm 234.

Referring to FIG. 12, the first male anchor 202 is illustrated in a locked, engaged, or attached configuration with the first female anchor receiver 192. The first male anchor 202 includes a lower housing 236 having a top wall 238 and an upper housing 240 on top of the lower housing 236. An actuating lever arm 242 is pivotally mounted within the lower housing 236 at one end through a pin or dowel 244 extending laterally the width of the lower housing 236, and further includes a second end 246 extending outwardly from the lower housing 236 and through the top wall 238 to provide support for a user's finger to actuate the mechanism.

A fourth linkage arm 248 is operably disposed within the lower housing and has a substantially W-shaped or wavy configuration. The fourth linkage arm 248 is centrally and pivotally mounted at a mid-point section 250 thereof through the pin or dowel 244 and includes a first engaging end 252 and an opposing second engaging end 254. The actuating lever arm 242 further includes an extension 256 which engages the lower portion of the second engaging end 254 as well as an upper portion of the second engaging end 254, wherein pressing the second end 246 of the actuating lever arm 242 would actuate the fourth linkage arm 248.

A plunger 258 includes a first end 260 and a second end 262 and slidably extends through the upper housing 240, wherein the second end 262 extends through an opening at a top wall 264 and engages the lower portion of the third linkage arm 234 through the opening 201. The first end 260 extends through an opening at the top wall 238 of the lower housing 236 and rests against the first engaging end 252 of the fourth linkage arm 248.

A coiled spring 266 is inserted through the first end 260 of the plunger 258, and includes a first end 268 resting against the lower surface of the top wall 238, and a second end 270 resting against the first engaging end 252 and providing a spring biased forced against the movement of the fourth linkage arm 248.

A directive anchor 272, similar to that of the directive anchors of the first embodiment for supporting the belt straps, includes a first end 274 attached to the upper surface of the top wall 238, and further includes a second engaging end having an arrow-head shape and configuration 276 with a laterally extending slit 278 therethrough. The arrow-head end 276 comprises a pair of opposing indentations 280 that provide for an engagement with the corresponding pair of tines 226 for the fork-shaped second portion 224.

Figure 14:
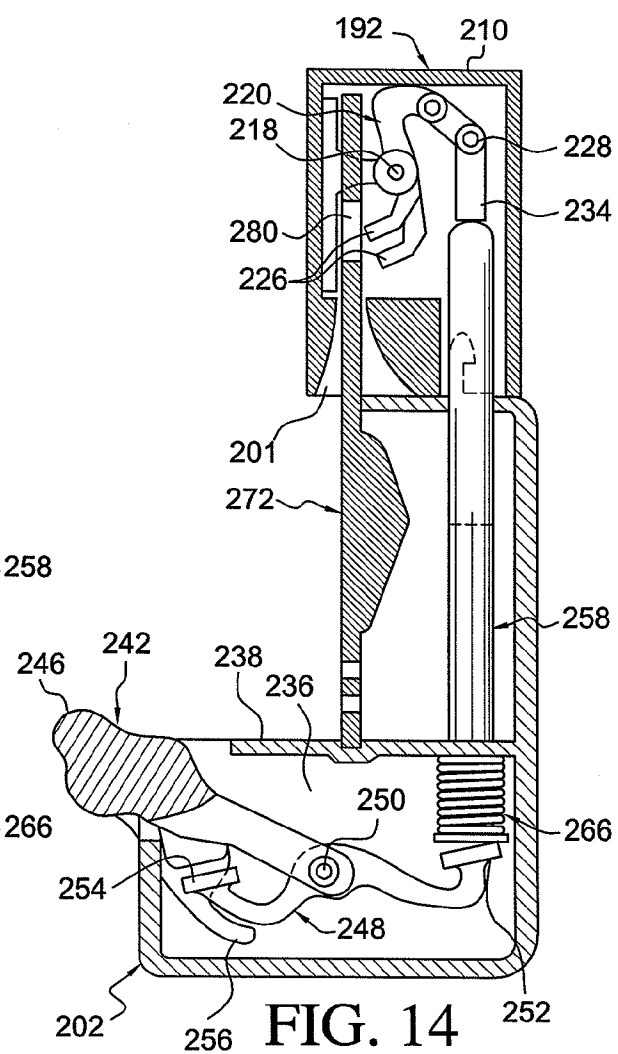
FIG. 14 is a cross-sectional view of the locking mechanism in a disengaged, unlocked, or released configuration.

Referring to FIG. 14, to disengage the first male anchor 202 from the first female anchor receiver 192, and thereby releasing the neck restraint system 10 from the user's helmet 14, a user presses the actuating lever arm 242 at the second end 246, causing the actuating lever arm 242 to pivot about the central pivot point 250, and further pivoting the fourth linkage arm 248 by pressing against the second engaging end 254. The first engaging end 253 presses against the first end 260 of the plunger 258, and compresses the coiled spring 266. The plunger 258 is moved upwardly and cause the third linkage arm 234 to move, and in turn causing the second linkage arm 228 to pivot, thereby causing the hook-shaped linkage arm 220 to pivot about the circular pivot end 218, which in turn cause the pair of tine 226 to move away and disengage the pair of indentations 280. Hence, the first male anchor 202 can be pulled down and away from the first female anchor 192.

Figure 15:
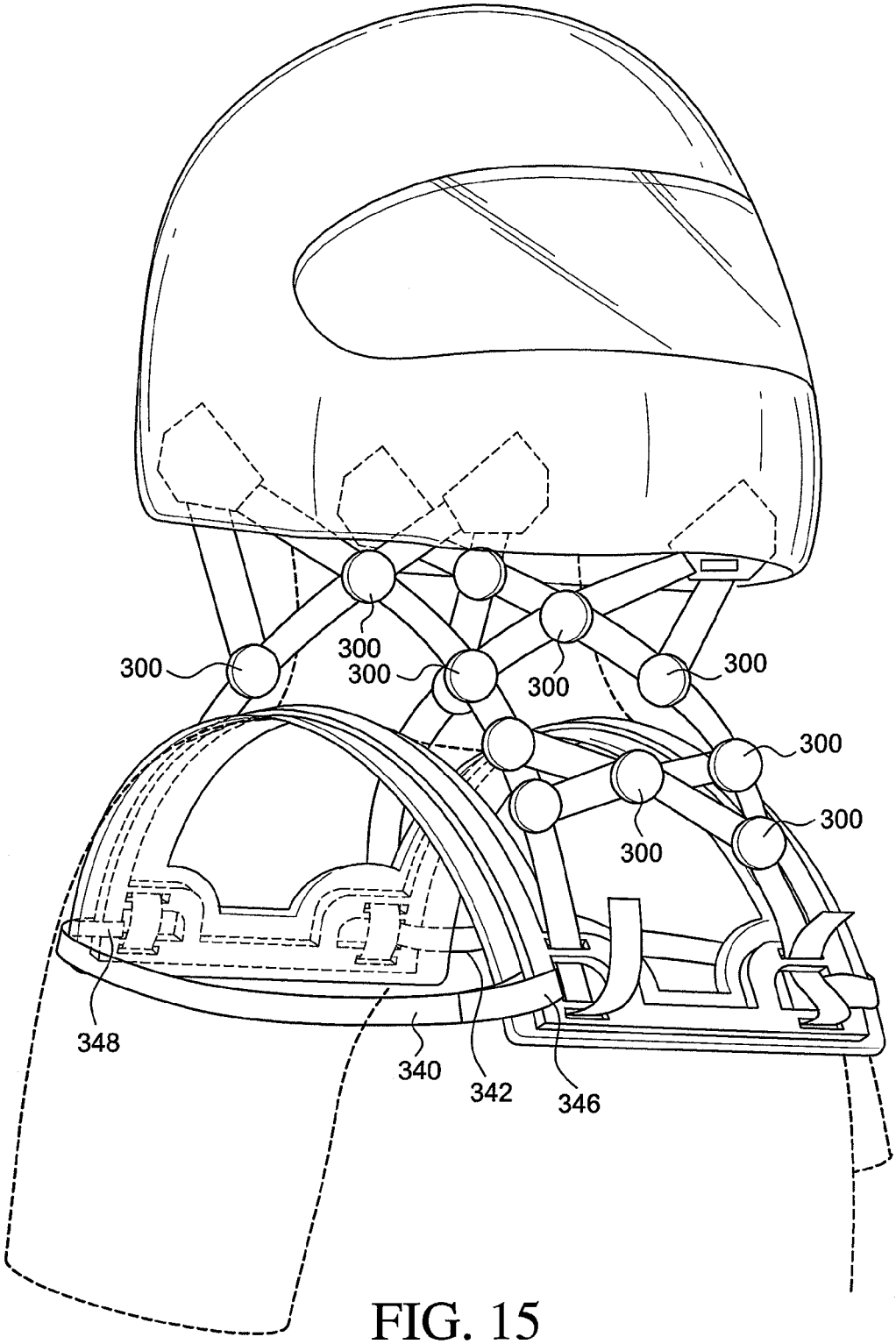
FIG. 15 is a perspective view of the neck restraint system in accordance with a fifth representative embodiment of the present invention.
Figure 16:
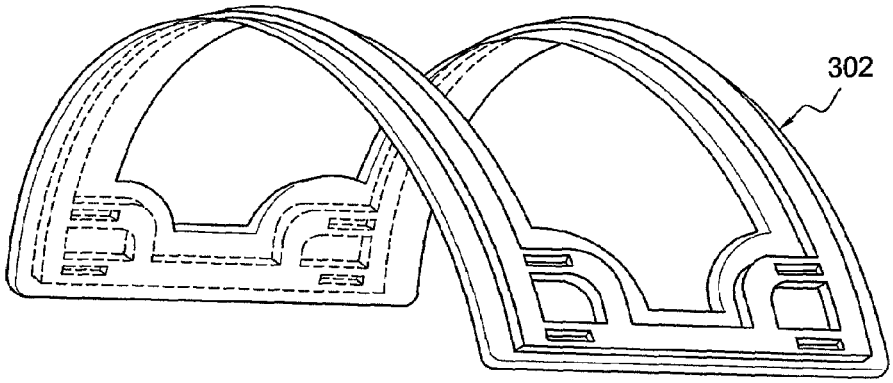
FIG. 16 is a perspective view of a shoulder support arc for the fifth representative embodiment shown in FIG. 15 in an assembled configuration.
Figure 17:
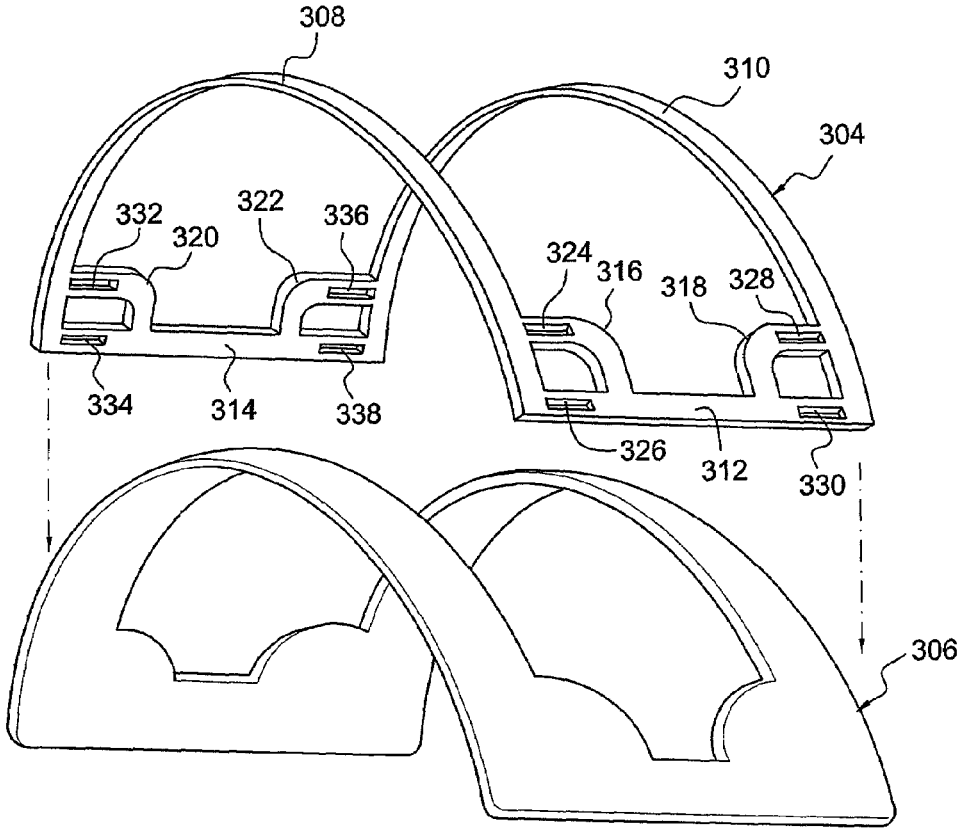
FIG. 17 is an exploded view of the shoulder support arc shown in FIG. 16.

Referring now to FIGS. 15 through 17, a fifth representative embodiment of the neck restraint system is illustrated. The neck restraint system includes a plurality of attaching knobs 300, wherein each knob 300 provides a securing means for replacing the stitching means for attaching the crossover or adjoining straps of the other embodiments. Each knob 300 may be of a snap fit configuration, or in the alternative, may have a sliding feature for allowing the length of the straps to adjust to a user's size.

A shoulder support arc 302 is alternatively provided to replace other means of securing the neck restraint system on the user such as attaching the restraint system to the user's race suit of providing leg anchors. The shoulder support arc 302 includes a first rigid arc portion 304 preferably made from, but not limited to, Kevlar or carbo fiber, and a foam portion 306 having the same shape and configuration as the rigid arc portion 304 which is attached to the underside of the first rigid arc portion 304 by securing means, such as, but not limited to, glue. The rigid arc portion 304 includes a semi-circular first side 308 and an opposing second semi-circular second side 310, which are attached together with an elongate front extension 312 and an elongate rear extension 314.

A first anchor strap 316 is provided at the adjoining corner of the first side 308 and the elongate front extension 312, a second anchor strap 318 is provided at the adjoining corner of the second side 310 and the elongate front extension 312, a third anchor strap 320 is provided at the adjoining corner of the first side 308 and the elongate rear extension 314, and a fourth anchor strap 322 is provided at the adjoining corner of the second side 310 and the elongate rear extension 314. The first anchor strap 316 includes a first slot 324 and a second slot 326 for receiving the strap and securing it to the shoulder support arc 302. Similarly, the second anchor strap 318 includes a first slot 328 and second slot 330, the third anchor strap 320 includes a first slot 332 and a second slot 334, and the fourth anchor strap 322 includes a first slot 326 and a second slot 338. The shoulder support arc 302 is placed over the user's shoulders and secured to the body by a first belt 340 extending under the user's armpit, the first end 346 of which is attached to the first anchor strap 316 and the second end 348 is attached to the third anchor strap 320. Similarly, a second belt 342 includes a first end 350 attached to the second anchor strap 318 and a second end 352 attached to the fourth anchor strap 322.

Referring now to FIGS. 18 through 22, a sixth representative embodiment of the neck restraint system is illustrated. In the embodiment, the first, second, third, and fourth anchor straps 316, 318, 320, and 322 are replaced with a first, a second, a third, and fourth recoil anchoring means 354, 356, 358, and 360. Each recoil anchoring means includes a dome-shaped housing 362 and an aperture 364 through which the strap belt extend outwardly. A recoil mechanism 366 is housed within the dome-shaped housing 362, wherein the recoil mechanism 366 functions to adjust the extendible length of the strap belt as well as locking the strap belt at a certain desired length.

The first and the second sides 308 and 310 each includes an adjusting means generally shown at 368. The first side 308 includes a front half portion 370 and a rear half portion 372 pivotally connected to the front half portion 370 by the adjusting means 368. More specifically, the front half portion 370 includes a plurality of substantially circular retaining means

374 attached for a peripheral edge thereof wherein each circular retaining means 374 is divided by a space 376 from the adjoining circular retaining means 374. Similarly, the rear half portion 372 includes a plurality of substantially circular retaining means 378 attached to a peripheral edge thereof and in a facing relation to the plurality of circular retaining means 374, wherein each circular retaining means 374 is divided by a space 380 from the adjoining circular retaining means 378.

Figures 20, 21, 22:
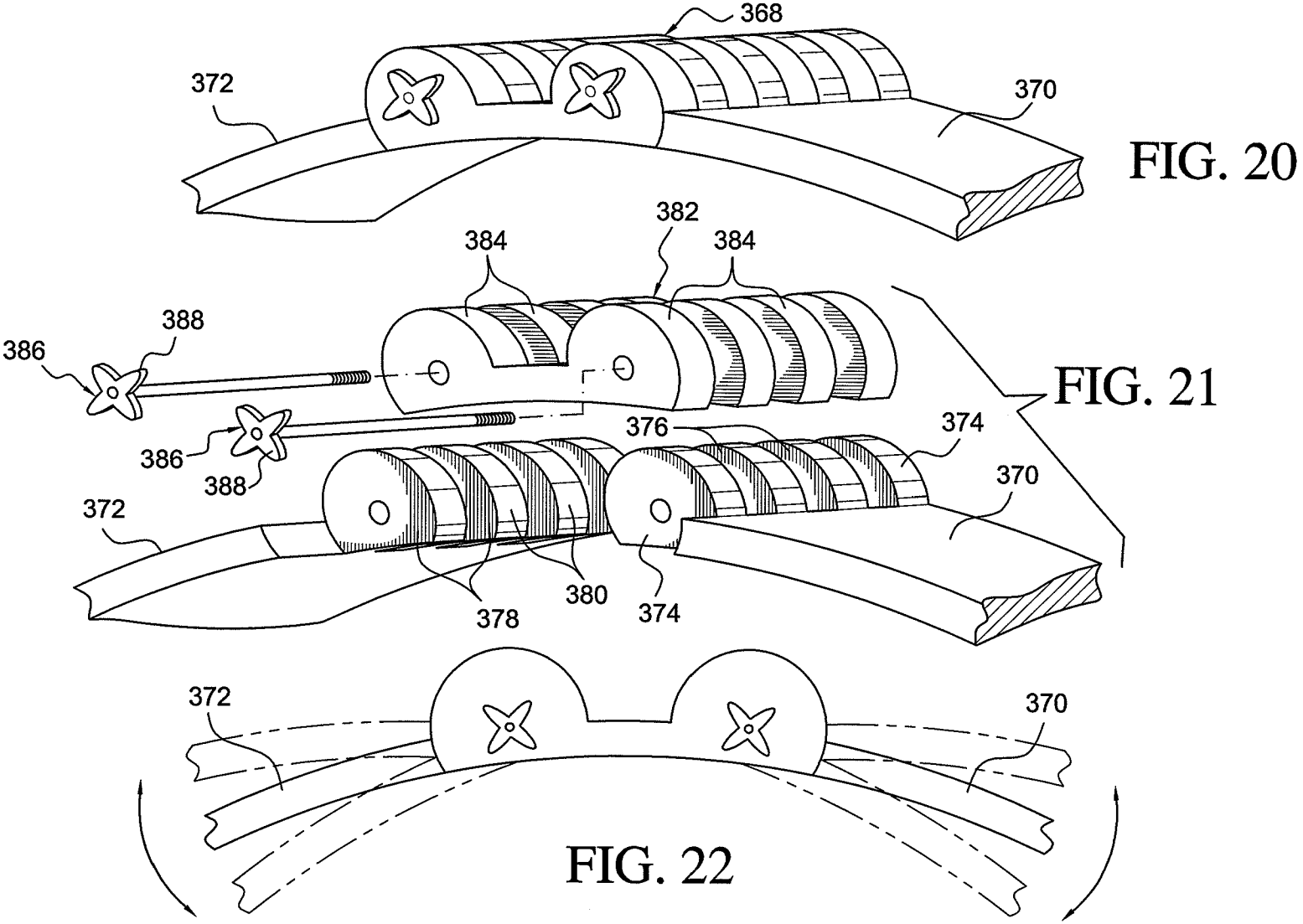
FIG. 20 is a perspective of a shoulder size adjusting means in an assembled configuration.
FIG. 21 is an exploded view of the shoulder size adjusting means shown in FIG. 20; and, FIG. 22 is a side sectional view of the should size adjusting means shown in FIG. 20.

A link 382 having a plurality of opposing circular retaining means 384 with a plurality of spaces 386 is provided and includes a shaped and configuration so that each circular retaining means 384 may be received within the corresponding space between the adjoining circular retaining means 374 on one side, and on the opposite side, each circular retaining means may be received within the corresponding space between the adjoining circular retaining means 378. The link 382 pivotally attaches the first half portion 370 to the second half portion 372 with a pair of elongated screws 386 each having a knob 388 at one end thereof, wherein the first half portion 370 and the second half portion 372 may be adjusted in a clockwise or counter clockwise motion, as best seen in FIG. 22, to adjust to the curvature and size of the user's shoulder, and then secured in that desired position by tightening the screws 386.

While preferred embodiments of the invention have been shown and described, various modifications and substitutions may be made thereto without departing from the spirit and scope of the invention. Accordingly, it is to be understood that the present invention has been described by way of illustration only, and this description should not be construed as limiting to the several claims appended hereto.

What is claimed is:

1. A head and neck restraint system for protecting the neck of an individual during a crash of a motor vehicle, said head and neck restraint system comprising:

a head enclosing helmet of the type having a head shell surrounding the head, forehead and chin of said individual with an opening at a bottom portion thereof and a face portion;

an arch-shaped shoulder support means for supporting the head and neck restraint system on the individual's shoulders wherein said arch-shaped shoulder support means further comprises a front half portion, a rear half portion and an adjusting means for adjusting the curvature of the arch-shaped shoulder support means and wherein said front half portion and said rear half portion are pivotally connected by said adjusting means;

means passing under the individual's arms fixed to said front half portion and said rear half portion for maintaining said arch-shaped shoulder support means on the shoulders of an individual;

a plurality of straps and means for securing said plurality of straps to a portion of said helmet;

means for releasably securing said plurality of straps to said arch-shaped shoulder support means; and wherein said plurality of straps form an X-pattern configuration on a right side and a left side of said individual below said helmet.

2. The head and neck restraint system of claim 1, wherein said arch-shaped shoulder support means further comprises rigid portion and a soft lower portion attached to a lower surface of said rigid portion.

3. The head and neck restraint system of claim 1, wherein said adjusting means further comprises a link pivotally attached to said front half portion and said rear half potion by a pair of elongated screws.

4. The head and neck restraint system of claim 3, wherein said plurality of straps includes a first strap, a second strap, a third strap and a fourth strap each having a first end attached to said helmet and a second end attached to said arch-shaped shoulder support means.

5. The head and neck restraint system of claim 4 further comprising a plurality of directive anchors attached to said helmet shell for securing and directing said first, second, third and fourth straps to said helmet.

6. The head and neck restraint system of claim 5 further including a pair of recoil mechanisms for adjusting extensible plurality of anchor straps attached to said user's outfit for securing the second end portions of said first and second straps.

7. The head and neck restraint system of claim 5 wherein each of said plurality of directive anchors include a plurality of slots for directing one of said first, second, third and fourth straps there through and securing the same to said helmet.

8. The head and neck restraint system of claim 4 wherein said plurality of straps form an X-pattern configuration on the front side and rear side of the individual.

* * * * *